United States Patent [19]

Fraser

[11] 4,295,730

[45] Oct. 20, 1981

[54] WASHER FOR RESIN-COATED PHOTOGRAPHIC PRINTS

[75] Inventor: David R. Fraser, Davis, Calif.

[73] Assignee: The United States of America as represented by the Secretary of Health and Human Services, Washington, D.C.

[21] Appl. No.: 174,238

[22] Filed: Jul. 31, 1980

[51] Int. Cl.[3] ..... G03D 3/04

[52] U.S. Cl. ..... 354/325; 354/328; 354/337; 366/166; 134/151; 134/199

[58] Field of Search ..... 354/312, 315, 324, 325, 354/326, 328, 331, 333, 335, 337; 366/166; 134/137, 151, 198, 199, 201

[56] References Cited

U.S. PATENT DOCUMENTS

| | | | |
|---|---|---|---|
| 323,721 | 8/1885 | Oliver | 354/326 |
| 335,002 | 1/1886 | Whiting . | |
| 779,483 | 1/1905 | MacIlwaine . | |
| 1,902,338 | 3/1933 | Riley . | |
| 2,446,958 | 8/1948 | Rowland | 354/337 |
| 2,682,213 | 6/1954 | Shapiro | 95/98 |
| 3,524,396 | 8/1970 | Blinoff, Jr. | 95/90 |
| 3,587,435 | 6/1971 | Chioffe | 354/325 |
| 3,604,331 | 9/1971 | Parlin et al. | 354/324 |
| 3,657,990 | 4/1972 | Wilhelm | 95/98 |
| 4,170,240 | 10/1979 | Gentry | 134/199 |
| 4,214,522 | 7/1980 | Bille | 354/325 |

*Primary Examiner*—L. T. Hix
*Assistant Examiner*—Alan Mathews
*Attorney, Agent, or Firm*—Browdy and Neimark

[57] ABSTRACT

A print-washing tank with generally rectangular spirally-looped pipes in parallel vertical arrays, fed by a horizontal input conduit in the upper portion of the tank, the arms of the pipes having holes to spray photographic prints on both sides with jets of water, the prints being supported between the vertical spray loops, using either wire baskets or being supported directly in the narrow vertical spaces between the spirally looped pipes. A drain pipe array is provided at the bottom of the tank, having a plurality of widely spaced intake ports and leading to a vertical siphon exit conduit near the back wall of the tank and which may be either inside the tank or may be located externally. The top loop of the siphon drain system is located slightly below the level of the water input pipe.

16 Claims, 9 Drawing Figures

WASHER FOR RESIN-COATED PHOTOGRAPHIC PRINTS

FIELD OF THE INVENTION

This invention relates to washers for photographic prints, and more particularly to a washer for resin-coated photographic prints, said washer being of the type adapted to support the resin-coated prints in substantially vertical positions and to keep the prints apart during washing.

BACKGROUND OF THE INVENTION

Resin-coated prints do not lend themselves to batch washing. Prints of this type are normally washed in a tray or similar receptacle, with water running through a siphon, or merely running into the top of the tray or receptacle. These techniques are satisfactory for small volumes of prints. A serious disadvantage of tray washing is that the prints tend to migrate away from the incoming water, which results in incomplete washing. Another problem appears when two prints are washed together and one overlies the other, which may also lead to incomplete washing. Also, it is necessary to wash resin-coated photographic papers in such a manner that the fluorescent brighteners are not leached from the paper base, thus creating a spotty appearance. With the prior art procedure, a darkroom worker must watch the prints and keep them separated. Thus, there is a substantial need for a print washer which is free of the above disadvantages.

A number of prior devices are shown in the patent literature (e.g. Whiting U.S. Pat. No. 335,002; MacIlwaine No. 779,483; Riley No. 1,902,338; Rowland No. 2,446,958; Shapiro No. 2,682,213; Blinoff, No. 3,524,396; Wilhelm No. 3,657,990), but these do not provide a solution to the problems of washing resin-coated prints.

SUMMARY OF THE INVENTION

The device of the present invention is primarily arranged for washing relatively large prints, such as 8"×10" prints, or 5"×7" prints, and, in a typical embodiment, may consist of a tank containing two sets of polyvinyl chloride pipes and connecting tees and elbows, which comprise the input and drain systems for wash water. The pipes are arranged with a series of turns, and may be arranged to hold two vertical print-supporting cages. Water enters the system through holes in the input tubing, which are arranged to flood the fronts and backs of the prints as they are supported vertically in the tank. The drain system is a siphon arrangement which starts to operate when the tank fills, and draws waste water from the bottom of the tank. The pipes of the water input system are perforated to provide many small jets of water which wash both sides of the prints simultaneously. This permits washing a plurality of prints at the same time, while keeping them apart, which removes the need for assigning a darkroom worker to watch the prints while they are being washed, and permits the worker to perform other tasks while the prints are washing.

Accordingly, an object of the invention is to provide an improved photographic print washing device which overcomes the deficiencies and disadvantages of previously used print washers.

A further object of the invention is to provide an improved photographic print washing device which enables simultaneously washing a plurality of prints on both sides with gentle uniform washing action and which maintains the prints separated during washing.

Another object is to provide for the improved washing of photographic, especially resin-coated, prints.

A still further object of the invention is to provide an improved print washer which supports a plurality of photographic prints in upright separated positions during washing and which applies many small jets of water simultaneously to both sides of the prints.

A still further object of the invention is to provide an improved photographic print washer which applies water simultaneously to both sides of a plurality of vertically supported prints, in the form of distributed small jets, and which is provided with a siphon drain system which draws waste water from the bottom of the associated tank, elevates it for discharge from the tank, and automatically provides substantially complete emptying of the tank when the water supply is turned off.

A still further object of the invention is to provide an improved photographic print washing device which achieves rapid and substantially uniform washing of the prints by employing many small jets of water distributed over the area of the print and which simultaneously washes both sides of a plurality of prints supported in upright positions in the device while holding the prints separated, said device having a siphon discharge system which permits rapid filling of the device and provides automatic substantially complete emptying of the device when the water is turned off, and which is arranged to hold the prints in stable upright positions while they are being washed, the device providing substantially uniform washing of the prints over their entire areas, being economical in the usage of water, being relatively compact in size, providing thorough circulation, and preventing chemical-laden water from being trapped in stagnant localized areas of the device without the necessity of employing extra water jets for required additional circulation.

BRIEF DESCRIPTION OF THE DRAWINGS

Further objects and advantages of the invention will become apparent from the following description and claims, and from the accompanying drawings, wherein:

DETAILED DESCRIPTION OF PREFERRED EMBODIMENTS

Figure 1:
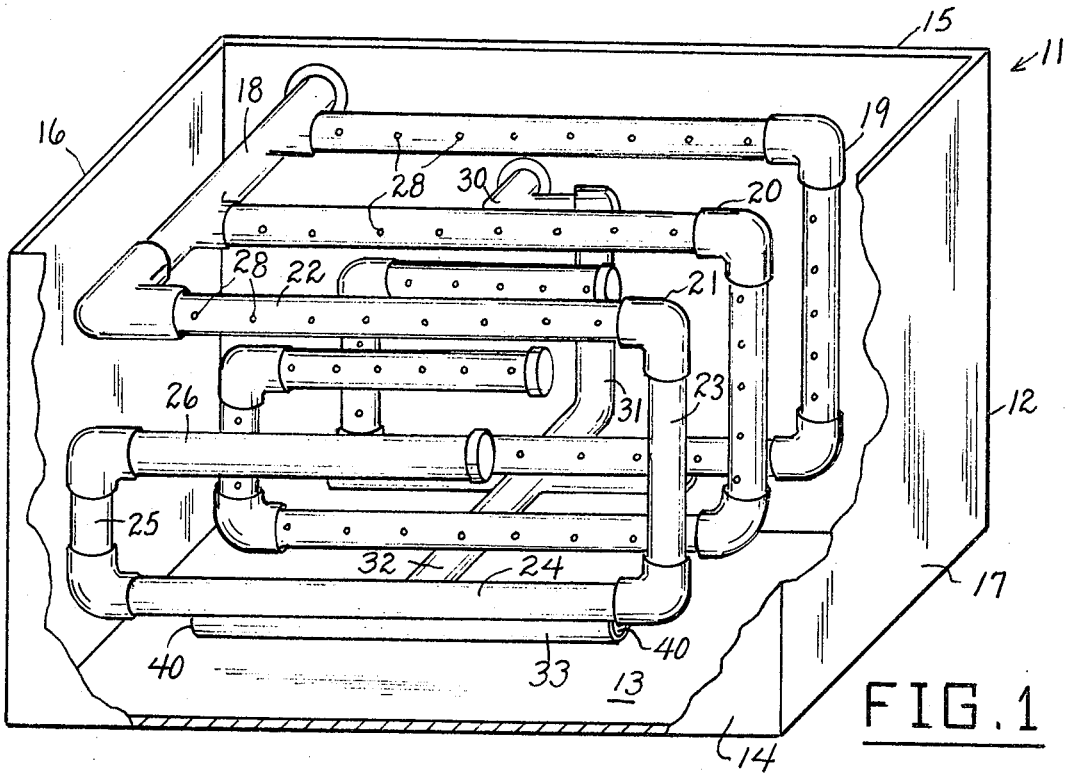
FIG. 1 is a perspective view, partly broken away, of one form of photographic print washing apparatus constructed in accordance with the present invention, shown with its associated print-supporting racks removed.
Figure 2:
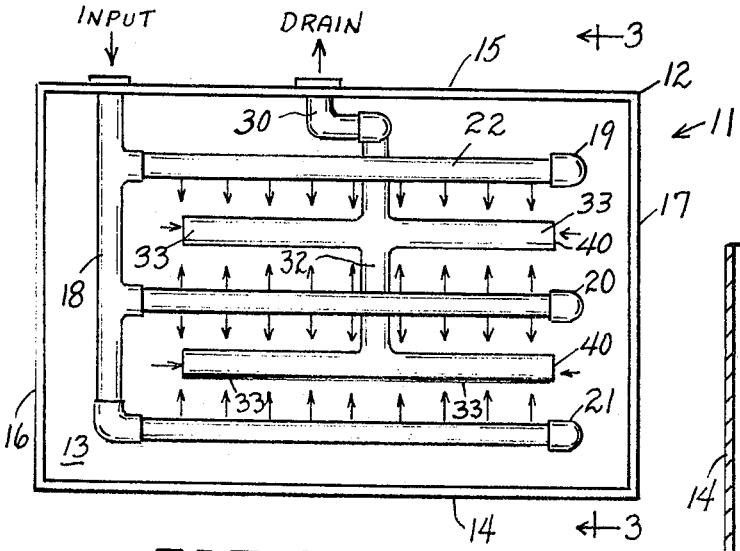
FIG. 2 is a top plan view, to a reduced scale, of the apparatus shown in FIG. 1.

Referring to the drawings, and more particularly to FIGS. 1 to 4, 11 generally designates a typical photographic print washing apparatus constructed in accordance with the present invention. The apparatus 11 comprises a generally rectangular tank 12 having a bottom wall 13, vertical front and rear walls 14 and 15, and vertical opposite end walls 16 and 17. Rigidly secured to and extending through the upper marginal portion of rear wall 15, and located adjacent to end wall 16 is a transverse water inlet pipe 18. Rigidly communicatively connected to inlet pipe 18 are three spaced longitudinally extending, substantially identical, vertical spray loops 19, 20 and 21, each having a horizontal longitudinal top arm 22, a depending vertical right end arm 23, as viewed in FIG. 1, a horizontal longitudinal bottom arm 24, an upstanding vertical left end arm 25, and an intermediate longitudinal sealed-end inner horizontal arm 26, each of said spray loops being contained in a respective longitudinal vertical plane, the parallel planes of the spray loops being spaced apart to define spaces therebetween adapted to receive print-supporting racks 27, in the manner shown in FIG. 3. The oppositely-facing portions of the arms of the spray loops are provided with evenly spaced water jet apertures 28 for delivering water jets to the opposite surfaces of upright photographic prints 29 contained in the racks 27. Said jets are provided by a suitable normally pressured water supply source connected to the water inlet pipe 18.

Rigidly secured to and extending through the upper intermediate portion of rear wall 15, at a level a short distance below that of inlet pipe 18, is a siphon discharge pipe 30 to which is connected a vertical pipe 31 extending upwardly from a transverse bottom pipe 32 having a plurality of longitudinal open-ended drain pipes 33 connected thereto, located in a horizontal plane near bottom wall 13. The water collection pipes 33 extend perpendicularly to the transverse drain pipe 32 and are located respectively in longitudinal vertical planes spaced substantially midway between the vertical planes of the spray loops 19, 20 and 21, whereby the longitudinally extending open-ended collection pipes 33 serve as bottom supports for the print racks 27 in the manner illustrated in FIG. 3.

Figure 4:
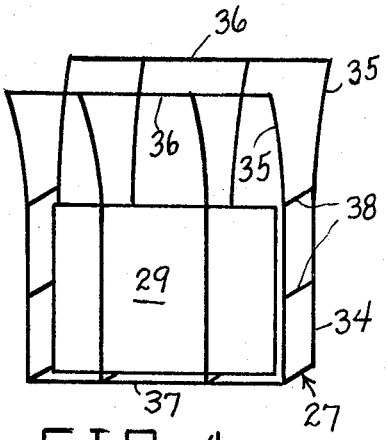
FIG. 4 is a perspective view of a print-supporting rack adapted to be used in the apparatus shown in FIGS. 1 to 3.
Figure 5:
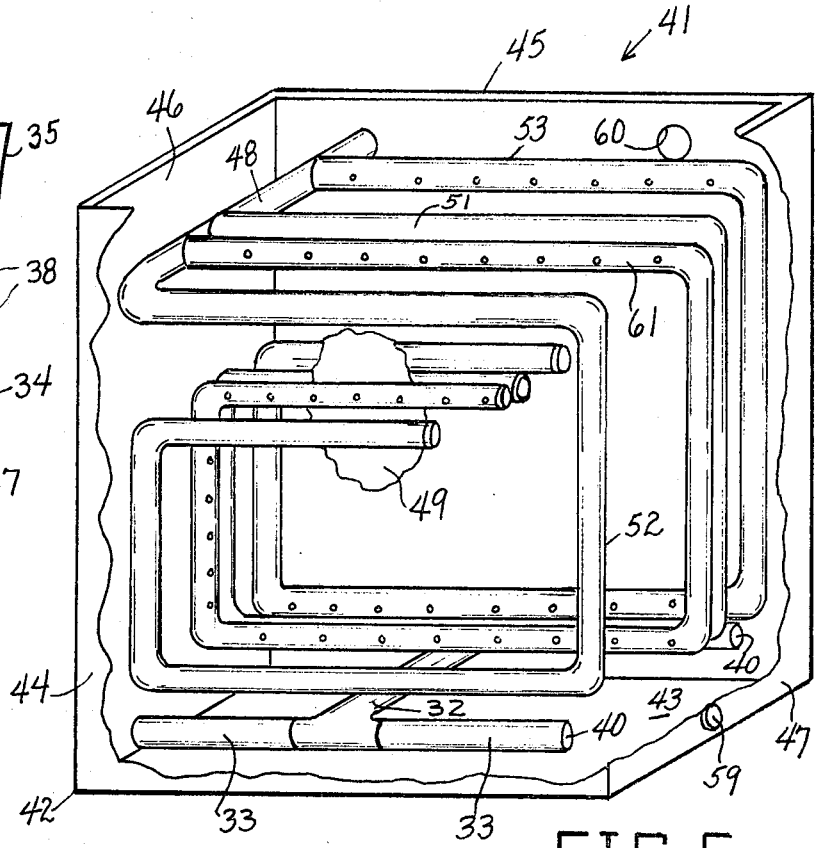
FIG. 5 is a perspective view, with parts broken away, of another embodiment of a photographic print washing apparatus according to the present invention.

As shown in FIG. 4, a typical print rack 27 may comprise a wire cage structure having spaced transverse U-shaped loops 34 with flaring top arm portions 35, 35, rigidly connected at their top ends by longitudinal rods 36, 36. The bottom corners of the loops 34 are rigidly connected by longitudinal bottom rods 37. Cross rods 38 rigidly connect the side arms of the loops 34 at vertically spaced locations, to serve as end closure elements of the wire basket structure thus defined. The flaring top arm portions 35 are relatively flexible and are adapted to yieldably engage with the top arms 22 of the two rack-receiving compartments defined between the three spaced vertical spray loops 19, 20 and 21.

Figure 3:
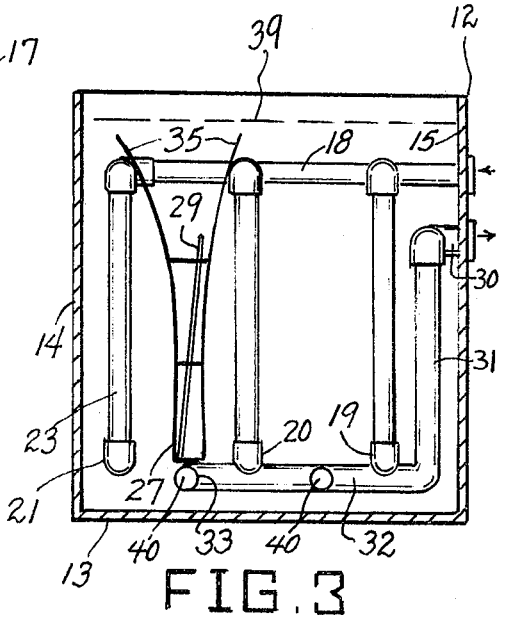
FIG. 3 is a transverse vertical cross-sectional view taken substantially on the line 3—3 of FIG. 2, shown with one of the print-supporting racks in operative position.

It will be noted that the spray loops 19, 20 and 21 define generally rectangular, longitudinally-elongated spiral configurations with jet apertures spaced so as to substantially simultaneously wash relatively evenly-distributed areas of opposite sides of a print 29 supported in an upright position in a rack 27 arranged in the manner shown in FIG. 3.

In operation, water is admitted into the tank via input pipe 18 and forms jets by discharging from the apertures 28, washing both sides of the rack-supported prints 29, as above described. The water fills the tank, and, with a sufficient intake rate, may establish a top level such as that shown at 39 in FIG. 3. The water discharges from the tank via the drain pipes 33, 32, 31 and 30, under continuous flow conditions. Due to the elevation of the discharge pipe 30 relative to the bottom of the tank, a siphon action is provided which enables most of the water to be automatically discharged from the tank following shut-off of the water supply to the input pipe 18. Thus, the drain system, with its siphon arrangement, permits rapid filling of the tank, and also provides fairly complete emptying after the water supply has been turned off.

The print holding cages 27 prevent the photographic prints from drifting away from the jets of wash water.

Part of the holes 28 may be directed away from the locations of the photographic prints. This is done to insure thorough circulation and to prevent chemical-laden water from lingering in quiet corners of the tank.

During operation, water enters the system in the form of jets through the holes 28, which are arranged to flood the fronts and backs of the prints in the cages 27. The siphon drain system starts to operate when the tank fills, and draws waste water from the bottom of the tank. The four inlet ports of the drain system, shown at 40, are close to the bottom of the tank, for ease of assembly, and because the chemical-laden wash water is substantially heavier than fresh water. The four drain ports 40 are in widely separated parts of the tank bottom portion and induce more uniform water circulation than that which would be provided by a single drain port.

FIGS. 5 to 9 illustrate another embodiment of the present invention, generally designated at 41. The apparatus 41 comprises a generally rectangular tank 42 having a bottom wall 43, vertical front and rear walls 44 and 45, and vertical opposite end walls 46 and 47. Rigidly secured to and extending through the upper marginal portion of rear wall 45 is a transverse water inlet pipe 48, located adjacent to end wall 46.

A drain system similar to that employed in the first-described embodiment is provided in the tank 42, said drain system comprising the transverse drain pipe 32 extending through and rigidly secured to the bottom portion of rear wall 45 and having the four open-ended longitudinally extending collection pipes 33 with intake ports 40. A perforated vertical central longitudinal partition wall 49 is provided in the tank, said partition wall having oppositely extending perforated bottom flanges 50, 50 overlying the drain pipes 32 and 33, and being employed as bottom supports for upright photographic prints to be washed in the apparatus.

Figure 6:
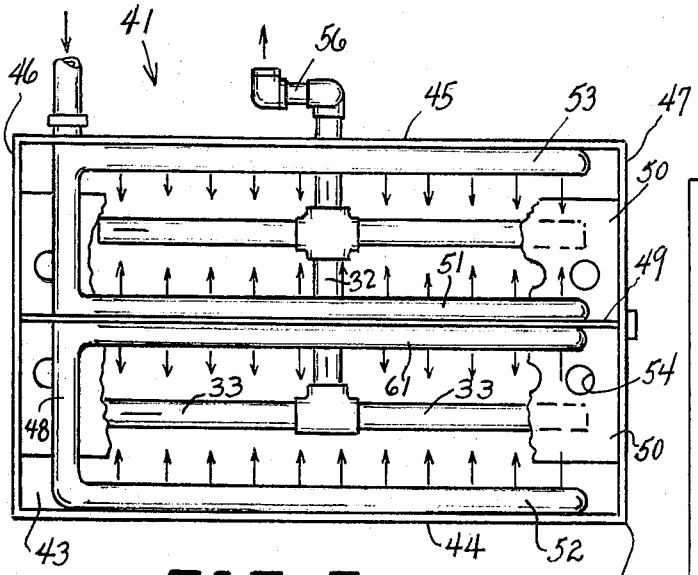
FIG. 6 is a top plan view, to a reduced scale and partly broken away, of the apparatus shown in FIG. 5.
Figure 7:
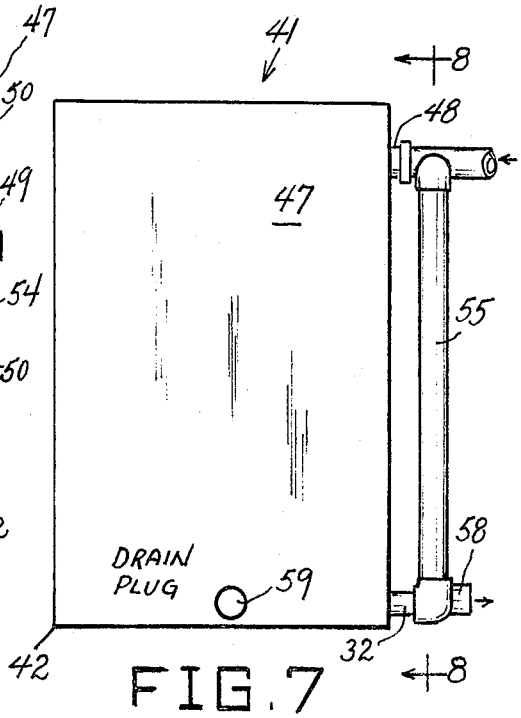
FIG. 7 is a side elevational view of the print washing apparatus of FIGS. 5 and 6.
Figure 8:
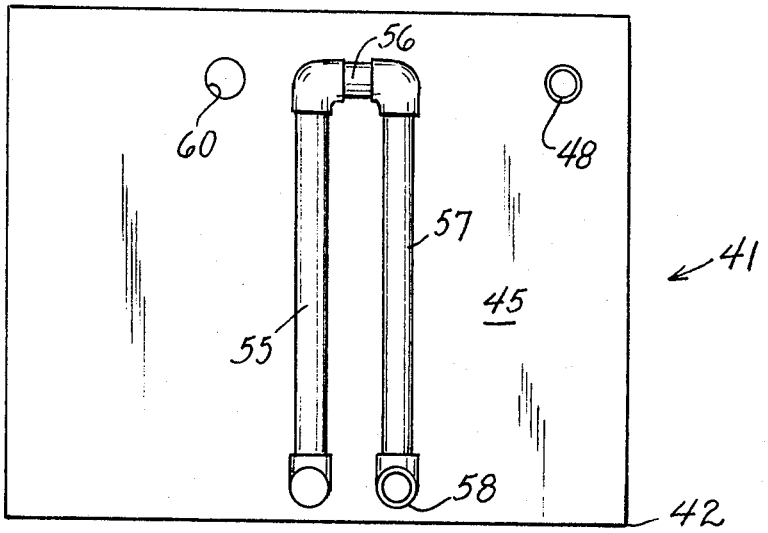
FIG. 8 is a rear elevational view taken substantially on the line 8—8 of FIG. 7.
Figure 9:
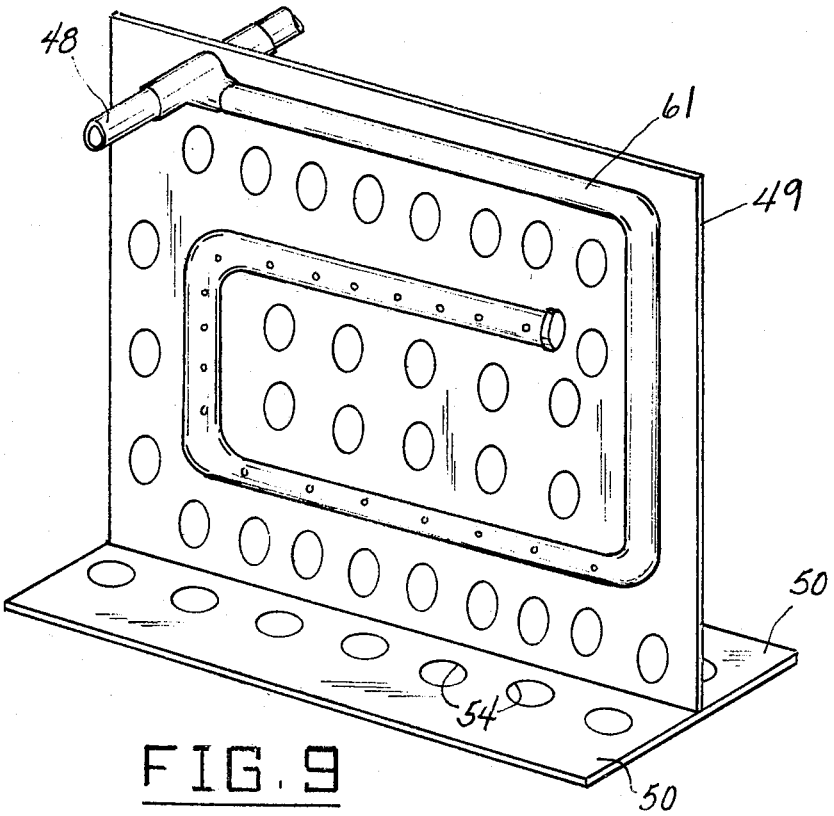
FIG. 9 is an enlarged perspective view of a tank divider member employed in the print washing apparatus of FIGS. 5 to 8, shown with its associated water jet-producing loop.

Communicatively connected to the transverse water inlet pipe 48 adjacent to and on opposite sides of the partition wall 49 are respective generally rectangular vertical spiral spray loops 61, 51 similar to those employed in the first-described embodiment, and communicatively connected to said inlet pipe 48 respectively inwardly adjacent to the front and rear walls 44, 45 are similar spray loops 52, 53. The respective compartments defined between the spray loops 61, 52 and 51, 53 are relatively narrow and are adapted to receive photographic prints therein in upright positions for washing by the water jets provided by the spray loops, in substantially the same manner as in the first-described embodiment of the invention. The apertures, shown at 54, in the bottom supporting flanges 50, 50 allow free descent of the wash water to the bottom of the tank for drainage through the drain system. The siphon arrangement employed with tank 42 is located externally, whereby to minimize the front-to-rear depth of the tank and reduce the amount of water required. Thus, as shown in FIGS. 6, 7 and 8, the outer end of drain pipe 32 is connected to a vertical external siphon pipe 55 rising almost to the level of water inlet pipe 48. A short horizontal pipe 56 connects the top end of pipe 55 to a descending vertical pipe 57 (see FIG. 8), whose lower end is in turn connected to a waste water discharge conduit 58. The arrangement thus described provides substantially the same siphon action as is obtained with the siphon system of the first-described embodiment of the invention.

In the embodiment of FIGS. 5 to 9, no print cages are needed because the relatively narrow enclosures defined between the respective pairs of spiral spray loops 52, 61 and 51, 53, with their associated bottom supporting flanges 50, 50 keep the prints in the required upright positions. Also, since the tank is smaller in front-to-rear depth than in the first-described embodiment, although of similar height and width, an equal or greater number of water changes per minute can be obtained, with a lower flow rate. Since there are fewer quiet corners, the previously described additional jets of water for extra circulation need not be employed.

A removable drain plug 59 is provided in the lower portion of end wall 47, close to bottom wall 43, to enable substantially complete emptying of the tank at the conclusion of its use, so as to maintain the tank dry between uses thereof and thereby prevent the growth of algae therein. An overflow aperture 60 is provided in the top portion of rear wall 45 to limit the maximum water level in the tank.

For convenient use, the tank may be placed in a large sink or similar receptacle having water drain or run-off means, thereby eliminating the need for connecting a drain conduit to the outlet of the tank drain system.

While certain specific embodiments of an improved photographic print washing apparatus have been disclosed in the foregoing description, it will be understood that various modifications within the scope of the invention may occur to those skilled in the art. Therefore it is intended that adaptations and modifications should and are intended to be comprehended within the meaning and range of equivalents of the disclosed embodiments.

What is claimed is:

1. A print-washing apparatus comprising a tank; a water inlet conduit mounted in the upper portion of said tank; a plurality of spaced parallel vertically arranged looped spray pipes located beneath the upper liquid level of said tank and communicatively connected to said water inlet conduit and defining vertical print-receiving spaces therebetween below the upper surface level of said tank; said looped spray pipes each having a plurality of water jet-forming apertures located along the entire length thereof; means to force water through said water inlet conduit and through said looped spray pipes and through said plurality of water jet-forming apertures so as to provide water jets on the surface of prints received in said vertical print-receiving spaces; means to soften the impact of said water jets to achieve a gentle washing action when in use, said means comprising a level of water in said tank when in use above the upper level of said looped spray pipes; a horizontally extending drain pipe array in the bottom portion of said tank and having a plurality of spaced inlet ports to receive waste water; and vertically arranged siphon discharge conduit means communicatively connected to said drain pipe array.

2. The print-washing apparatus of claim 1, and wherein said vertically arranged looped spray pipes have a generally rectangular configuration.

3. The print-washing apparatus of claim 1, and wherein said vertically arranged looped spray pipes are in the form of horizontally elongated spirals.

4. The print-washing apparatus of claim 1, and wherein said vertically arranged looped spray pipes are in the form of generally rectangular, horizontally elongated spirals with closed ends.

5. The print-washing apparatus of claim 1, and wherein said drain pipe array includes drain inlet pipes underlying the print-receiving spaces.

6. The print-washing apparatus of claim 5, and wherein each of said drain inlet pipes is located in a vertical plane parallel to and located between the vertical planes of a pair of adjacent looped spray pipes.

7. The print-washing apparatus of claim 1, and cage means in the spaces between the looped spray pipes for supportingly receiving photographic prints.

8. The print-washing apparatus of claim 7, and wherein the looped spray pipes have horizontal top arms supportingly engageable by said cage means.

9. The print-washing apparatus of claim 1, and wherein said siphon discharge conduit means is located externally of said tank.

10. The print-washing apparatus of claim 1, and wherein said siphon discharge conduit means comprises an inverted U-shaped conduit communicatively connected to said drain pipe array and extending vertically to a level a short distance subjacent to that of the water inlet conduit.

11. The print-washing apparatus of claim 1, and wherein said drain pipe array comprises a main transverse bottom pipe having a plurality of open-ended inlet drain pipes perpendicularly connected thereto, said inlet drain pipes being located respectively in vertical planes spaced substantially midway between the vertical planes of the vertically arranged looped spray pipes.

12. The print-washing apparatus of claim 11, and wherein said siphon discharge conduit means comprises a vertical siphon inlet pipe communicatively connected to one end of said main transverse bottom pipe and rising to a level a short distance below that of the water inlet conduit, and a siphon discharge conduit connected to the top end of said vertical siphon inlet pipe.

13. A print-washing apparatus comprising a tank, a water inlet conduit mounted in the upper portion of the tank, a plurality of spaced parallel vertically arranged looped spray pipes communicatively connected to said water inlet conduit and defining vertical print-receiving spaces therebetween, the looped spray pipes each having arms provided with water jet-forming apertures located so as to provide water jets on the surfaces of prints received in said spaces, a horizontally extending drain pipe array in the bottom portion of said tank and having a plurality of spaced inlet ports to receive waste water, vertically arranged siphon discharge conduit means communicatively connected to said drain pipe array, and cage means in the spaces between the looped spray pipes for supportingly receiving photographic prints, wherein the looped spray pipes have horizontal top arms supportingly engageable by said cage means, and wherein said drain pipe array includes horizontal inlet pipes underlying the print-receiving spaces and being supportingly engaged by said cage means.

14. The print-washing apparatus of claim 13, and wherein said cage means is in the form of narrow baskets adapted to support photographic prints in upright positions, and wherein the horizontal inlet drain pipes longitudinally underlie said baskets.

15. A print-washing apparatus comprising a tank, a water inlet conduit mounted in the upper portion of the tank, a plurality of spaced parallel vertically arranged looped spray pipes communicatively connected to said water inlet conduit and defining vertical print-receiving spaces therebetween, the looped spray pipes each having arms provided with water jet-forming apertures located so as to provide water jets on the surfaces of prints received in said spaces, a horizontally extending drain pipe array in the bottom portion of said tank and having a plurality of spaced inlet ports to receive waste water, vertically arranged siphon discharge conduit means communicatively connected to said drain pipe array, and wherein said tank is provided with a vertical partition wall located between two respective pairs of spaced parallel vertically arranged looped spray pipes, said partition wall having bottom flanges forming print-supporting surfaces in the print-receiving spaces defined by the looped spray pipes.

16. The print-washing apparatus of claim 15, and wherein said drain pipe array includes drain inlet pipes underlying said bottom flanges.

* * * * *